US005631686A

United States Patent [19]

Castelli et al.

[11] Patent Number: 5,631,686

[45] Date of Patent: May 20, 1997

[54] METHOD TO PROVIDE OPTIMUM OPTICAL CONTRAST FOR REGISTRATION MARK DETECTION

[75] Inventors: Vittorio Castelli, Yorktown Heights, N.Y.; David L. Hecht, Palo Alto, Calif.

[73] Assignee: Xerox Corporation, Stamford, Conn.

[21] Appl. No.: 168,300

[22] Filed: Dec. 17, 1993

[51] Int. Cl.[6] ..... B41J 2/385; G03G 21/00

[52] U.S. Cl. ..... 347/133; 347/116; 399/53

[58] Field of Search ..... 347/133, 119, 347/118, 105, 178, 115, 232, 15, 19, 14, 116; 355/208, 326

[56] References Cited

U.S. PATENT DOCUMENTS

| | | | |
|---|---|---|---|
| 4,125,322 | 11/1978 | Kaukeinen et al. | 347/118 |
| 4,804,979 | 2/1989 | Kamas et al. | 346/157 |
| 4,903,067 | 2/1990 | Murayama et al. | 346/160 |
| 4,916,547 | 4/1990 | Katsumata et al. | 358/300 |
| 4,956,223 | 9/1990 | Arai et al. . | |
| 4,963,899 | 10/1990 | Resch | 346/157 |
| 4,965,597 | 10/1990 | Ohigashi et al. | 346/157 |
| 5,142,356 | 8/1992 | Usami et al. . | |
| 5,227,815 | 7/1993 | Dastin et al. | 347/116 |
| 5,257,037 | 10/1993 | Haneda et al. . | |
| 5,276,459 | 1/1994 | Danzuka et al. | 347/14 |
| 5,361,089 | 11/1994 | Bearss et al. | 347/119 |

*Primary Examiner*—Benjamin R. Fuller
*Assistant Examiner*—Thinh Nguyen
*Attorney, Agent, or Firm*—Kevin R. Kepner

[57] ABSTRACT

A method of achieving optimum optical contrast for detecting registration marks in a multicolor electrophotographic printing machine. The reflectivity of the image carrying member which is usually an intermediate transfer belt is determined. The reflectivity of each of the toners is then determined. If one of the toners has a contrasting reflectivity, while the remaining toners do not contrast then a uniform field of the contrasting toner is imaged and developed and the registration marks for the other toner colors are then developed on top of the uniform field. A void in the field in the shape of the other toner marks is used as the registration mark for the contrasting toner. If all of the toners have a contrasting reflectivity with the belt, the registration marks are imaged and developed directly on the belt.

4 Claims, 5 Drawing Sheets

METHOD TO PROVIDE OPTIMUM OPTICAL CONTRAST FOR REGISTRATION MARK DETECTION

This invention relates generally to the registration of color images in a color image output terminal, and more particularly concerns an improved color image alignment system utilizing an improved method for providing optimum optical contrast for detecting registration marks in full color electrophotographic printing machines.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotographic, it is desirable to use the so-called tandem architecture which comprises a plurality of image forming stations. This tandem architecture offers a high potential for throughput and image quality. One choice of photoreceptors in this tandem engine architecture is a drum based photoreceptor architecture used in combination with an intermediate transfer belt.

Image registration is an important and difficult problem in a xerographic color image output terminal. In FIG. 5, a color image output terminal is shown having four photoreceptors 22. Each photoreceptor carries a unique color separation obtained by a conventional xerographic processor having charge device 26, write device 80 and develop device 30. The four color separations are transferred to intermediate belt 10 so as to coincide with one another and produce a full color image. Subsequently, the color image is transferred to paper and the color image is fixed thereon. Alternatively, belt 10 can be a copy sheet conveyor so that the four color separations are transferred directly to the delivery medium.

In order to deliver good quality images, strict specifications are imposed on the accuracy with which the color image output terminal 10 superimposes the various color separations which compose the individual images. This juxtaposition accuracy is often called registration. In the trade, a limit of 125 micrometers is considered a maximum for acceptable misregistration errors of quality pictorial color images and a 75 micrometer limit is often imposed as a limit by the manufacturers of top quality equipment. Some imaging techniques require registration accuracy of 15 micrometers for pictorial information. An accuracy of 35 micrometers is typically required for the printing of fine colored text. These numbers represent the diameter of a circle which would encompass all supposedly homologous color dots.

In a single pass image output terminal, the various color separations are produced by separate imaging members and are passed to the intermediate belt where they are collected in juxtaposition. Registration errors can arise from motion errors of the collecting device and from mismatch of the individual color separations from the imaging device.

With respect to the motion of the collecting device, good registration goals are attainable if the unit is designed such that its kinematic errors are made synchronous with the spacing distance between successive image transfer points of the photoreceptors 22 and belt 10. In this manner, the modulation of the surface motion is repeatable (synchronous) with the imaging pitch and color-on-color separation errors are minimized. Although the absolute position error of each color may be large, the relative position error between colors is held to specification. The absolute image distortion is usually tolerable. In tandem image output terminals, where the separations are generated and developed on individual photoreceptors and then transferred to an intermediate belt, a mismatch in the motion errors of the photoreceptors contributes to misregistration.

In tandem image output terminals, where the separations are generated and developed on individual photoreceptors and then transferred to an intermediate belt, problems arise due to mismatch in the motion errors of the photoreceptors and due to the photoreceptor eccentricity and wobble. The mismatch contributes to misregistration in the process direction; the eccentricity contributes to variable lateral magnification error; and wobble contributes to lateral registration variations. The eccentricity and wobble contributions exist only in machines where the writing is performed by a light beam scanning through a finite angle (usually called ROS for Raster Output Scanner). Image bars do not present these problems.

One common way of improving registration is described in U.S. Pat. No. 4,903,067 to Murayama et al. Murayama et al. employ a marking system with a detector for measuring alignment errors and mechanically move individual color printers to correct misalignment.

Color printers that employ marks produced by each of the constituent colors in juxtaposition with each other enable correction of lateral and longitudinal relative position, skew and magnification. The marks may be machine readable, and data may be processed to measure registration errors for the purpose of automating registration error correction. However, such corrections cannot compensate for the errors introduced by mismatch in the velocity variations of the photoreceptors because these errors differ both in phase and magnitude and are in no way steady or synchronous with the image transfer pitch. For example, a photoreceptor drum characterized by an eccentricity and wobble may rotate with an instantaneous rotational velocity that repeatably varies as a function of the rotational phase angle such that an average rotational velocity over a complete rotation would inaccurately characterize the instantaneous rotational velocity at any single rotational phase angle.

Measurement of the position of each of the registration marks may be accomplished by illuminating the marks and employing a lens to collect the diffusely reflected light to image the reflection on photodetectors or photodetector arrays. The illumination may be in the visible wavelength or at near infrared (IR) wavelength. In order to reliably detect the position of the registration mark, the diffuse reflection from the registration mark must be significantly different from its background. It is desirable therefore, to achieve high contrast for bright or black belts and for image output terminals (IOTs) for which the first printed color has high or low diffuse reflectivity.

The following disclosures may be relevant to various aspects of the present invention:

U.S. Pat. No. 4,965,597 Patentee: Ohigashi et al. Issued: Oct. 23, 1990

U.S. Pat. No. 4,963,899 Patentee: Resch,III Issued: Oct. 16, 1990

U.S. Pat. No. 4,916,547 Patentee: Katsumata et al. Issued: Apr. 10, 1990

U.S. Pat. No. 4,903,067 Inventor: Murayama et al. Issue Date: Feb. 20, 1990

U.S. Pat. No. 4,804,979 Patentee: Kamas et al. Issued: Feb. 14, 1989

U.S. application Ser. No. 07/899,187 Inventor: de Jong et al. Filing Date: Jun. 16, 1992

The relevant portions of the foregoing disclosures may be briefly summarized as follows:

U.S. Pat. No. 4,965,597 discloses a color image recording apparatus which superimposes a plurality of different color images on one another to form a composite image. Registration marks are formed on a recording medium and are sensed at each station to assure a clear and accurate superimposed image. A sensor senses one or both edges of a recording medium to note image deviations caused by transport to enable compensation thereof.

U.S. Pat. No. 4,963,899 discloses a method and apparatus for image frame registration in which registration indicia for registering an image frame are written on a photosensitive member in an interframe or frame margin area. A sensor array provides in-track and cross-track signal information to a control unit for synchronizing the electrostatic process of the registered image frames.

U.S. Pat. No. 4,916,547 discloses a color image forming apparatus which produces a single composite color image on a paper. The paper is transported by a belt and the composite color image is formed by transferring image components of different colors to the paper in register with each other. The apparatus reduces positional deviation of a plurality of image components of different colors by sensing signals on a surface of the transfer belt outside a paper region. The sensor senses arriving pattern images and corrects for unaligned images by calculating a deviation amount and adjusting a timing signal accordingly.

U.S. Pat. No. 4,903,067 discloses an apparatus having multiple image forming devices and a correcting scheme to correct positional deviations of the images so that the images can be accurately transferred to a sheet based upon matching position registration marks.

U.S. Pat. No. 4,804,979 discloses a single pass color printer/plotter having four separate microprocessor-based print stations, each for printing a different color image for superimposition with one another to form a full color image. The printer includes a registration system where each print station monitors registration marks to correct for media variations. Each print station includes optical sensors that monitor the marks printed on the media edge to synchronize the printing and align the images properly.

U.S. application Ser. No. 07/899,187 describes a system includes a marking device for applying to a process medium a first chevron from a first printer, a second chevron from a second printer and a third chevron from both the first printer and the second printer, the third chevron having a first element applied from the first printer and a second element applied from the second printer. The detection system further includes a detection device for detecting a matrix of times including three pluralities of times, each of the three pluralities of times corresponding to a respective time of passage of the first, second and third chevrons by the detection device. The detection system further includes a determining device for determining the alignment error based on a function of the three pluralities of times. A control system includes a marking device for applying to a process medium a first chevron from a first printer, a second chevron from a second printer and a third chevron from both the first printer and the second printer. The control system further includes a detection device for detecting a matrix of times including three pluralities of times, each of the three pluralities of times corresponding to a time of passage of a respective one of the first, second and third chevrons by the detection device, a determining device for determining an alignment error based on a function of the matrix of times, and a control device for minimizing the alignment error.

In accordance with one aspect of the present invention, there is provided a method of achieving optical contrast between an image carrying media having a reflectivity value and a plurality of marking materials having a reflectivity value. The method comprises the steps of determining the reflectivity value of the image carrying media and determining the reflectivity value for each of the plurality of marking materials. The step of writing a geometric pattern with the plurality of marking materials on the image carrying media to obtain the maximum optical contrast is also included.

Pursuant to another aspect of the present invention, there is provided a method of achieving optical contrast between an image carrying media having a certain reflectivity value and a plurality of marking materials having a reflectivity value. The method comprises the steps of determining the reflectivity value of the image carrying media and determining the reflectivity value for each of the plurality of marking materials. The steps of depositing a uniform pattern, based on the determined reflectivity values of the image carrying media and the plurality of marking materials, of at least one of the marking materials having a reflectivity value contrasting from the image media value when not all of the marking materials have a determined contrasting reflectivity value different from the image carrying media reflectivity value and depositing a geometric pattern, based on the determined reflectivity values of the image carrying media and the plurality of marking materials, with the remaining plurality of marking materials having a non-contrasting reflectivity value with the image carrying media reflectivity value, over the uniform pattern of the one contrasting marking material so as to obtain maximum optical contrast are also included.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
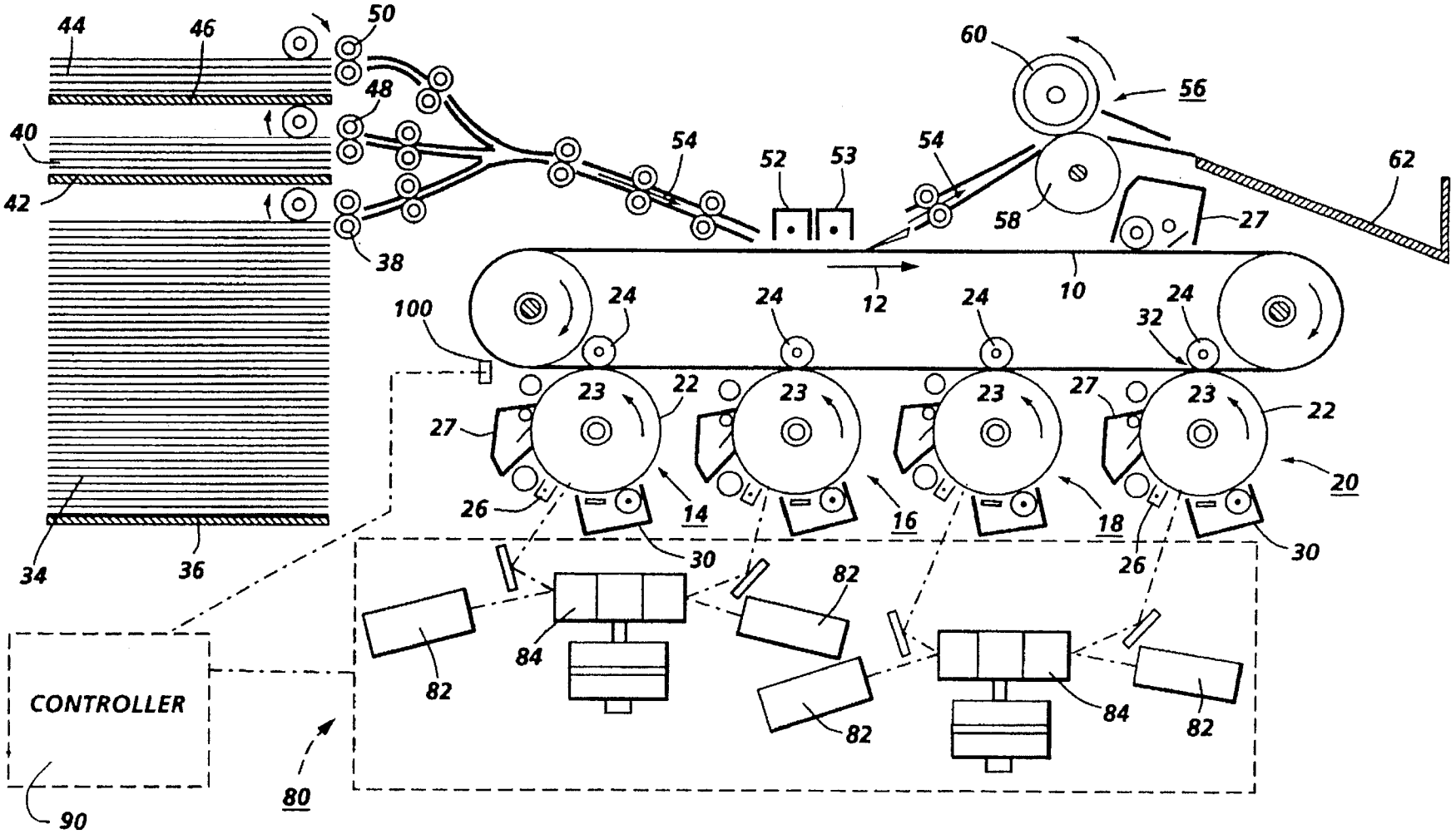
FIG. 5 is a schematic diagram of a four color image output terminal utilizing the contrast scheme of the present invention.

For a general understanding of the features of the present invention references are made to the drawings. In the drawings, like reference numerals have been used throughout to designate identical elements. Referring now to FIG. 5, an intermediate belt designated generally by the reference numeral 10 is mounted rotatably on the machine frame. Belt 10 rotates in the direction of arrow 12. Four imaging reproducing stations indicated generally by the reference numerals 14, 16, 18 and 20 are positioned about the periphery of the belt 10. Each image reproducing station is substantially identical to one another. The only distinctions between the image reproducing stations is their position and the color of the developer material employed therein. For example, image reproducing station 14 uses a black developer material, while stations 16, 18 and 20 use yellow, magenta and cyan colored developer material. Inasmuch as stations 14, 16, 18 and 20 are similar, only station 20 will be described in detail.

At station 20, a drum 22 having a photoconductive surface deposited on a conductive substrate rotates in direction of arrow 24. Preferably, the photoconductive surface is made from a selenium alloy with the conductive substrate being made from an electronically grounded aluminum alloy. Other suitable photoconductive surfaces and conductive substrates may also be employed. Drum 22 rotates in the direction of arrow 23 to advance successive portions of the photoconductive surface through the various processing stations disposed about the path of movement thereof.

Initially, a portion of the photoconductive surface of drum 22 passes beneath a corona generating device 26. Corona generating device 26 charges the photoconductive surface of the drum 22 to a relatively high, substantially uniform potential.

Next, the charged portion of the photoconductive surface is advanced through the imaging station. At the imaging station, an imaging unit indicated generally by the reference numeral 80, records an electrostatic latent image on the photoconductive surface of the drum 22. Imaging unit 80 includes a raster output scanner. The raster output scanner lays out the electrostatic latent image in a series of horizontal scan lines with each line having a specified number of pixels per inch. Preferably, the raster output scanner employs a laser 82 which generates a modulated beam of light rays which are scanned across the drum 22 by rotating a polygon mirror 84. The beam of light rays is controlled by controller 90 which sends the image data to the imaging unit 80. The image data may be obtained from a raster input scanner (RIS) (not shown) or may be sent directly to the controller 90 as video input from an external source. Alternatively, the raster output scanner may use light emitting diode array write bars. In this way, an electrostatic latent image is recorded on the photoconductive surface of the drum 22.

Next, at image reproducing station 213, a developer unit indicated generally by the reference numeral 313 develops the electrostatic latent image with a cyan colored developer material. Image reproducing stations 14, 16 and 18 use black, yellow, and magenta colored developer materials respectively. The latent image attracts toner particles from the carrier granules of the developer material to form a toner powder image on the photoconductive surface of drum 22. After development of the latent image with cyan toner, drum 22 continues to move in direction of arrow 24 to advance the cyan toner image to a transfer zone 32 where the cyan toner image is transferred from drum 22 to intermediate belt 10 by an intermediate transfer device such as a biased transfer roll 24.

At transfer zone 32, the developed powder image is transferred from photoconductive drum 22 to intermediate belt 10. Belt 10 and drum 22 have substantially the same tangential velocity in the transfer zone 32. Belt 10 is electrically biased to a potential of sufficient magnitude and polarity by biased transfer roll 24 to attract the developed powder image thereto from drum 22. Preferably, belt 10 is made from a conductive substrate with an appropriate dielectric coating such as a metalized polyester film.

After the cyan toner image is transferred to the belt 10 at reproducing station 20, belt 10 advances the cyan toner image to the transfer zone of reproducing station 18 where a magenta toner image is transferred to belt 10, in superimposed registration with the cyan toner image previously transferred to belt 10. After the magenta toner image is transferred to belt 10, belt 10 advances the transferred toner images to reproducing station 16 where the yellow toner image is transferred to belt 10 in superimposed registration with the previously transferred toner images. Finally, belt 10 advances the transferred toner images to reproducing station 14 where the black toner image is transferred thereto in superimposed registration with the previously transferred toner images. After all of the toner images have been transferred to belt 10 in superimposed registration with one another to form a multicolor toner image, the multicolor toner image is transferred to a sheet of support material, e.g., a copy paper at the transfer station.

At the transfer station, a copy sheet is moved into contact with the multicolor toner image on belt 10. The copy sheet is advanced to transfer station from a stack of sheets 34 mounted on a tray 36 by a sheet feeder 38 or from either a stack of sheets 40 on tray 42 or a stack of sheets 44 on a tray 46 by either sheet feeder 48 or sheet feeder 50. The copy sheet is advanced into contact with the multicolor image on belt 10 beneath corona generating unit 52 at the transfer station. Corona generating unit 52 sprays ions on to the back side of the sheet to attract the multicolor image to the front side thereof from belt 10. After transfer, the copy sheet passes under a second corona generating unit 53 for detack and continues to move in the direction of arrow 54 to a fusing station. The fusing station includes a fuser assembly generally indicated by the reference numeral 56, which permanently affixes the transferred toner image to the copy sheet. Preferably, fuser assembly 56 includes a heated fuser roll 58 and a backup roller 60 with the toner image on the copy sheet contacting fuser roller 58. In this manner, the toner image is permanently affixed to the copy sheet. After fusing, the copy sheets are then fed either to an output tray 62 or to a finishing station, which may include a stapler or binding mechanism.

Referring once again to reproducing station 20, invariably, after the toner image is transferred from drum 22 to belt 10, some residual particles remain adhering thereto. These residual particles are removed from the drum surface 22 at the cleaning station 27. Cleaning station includes a rotatably mounted fibrous or electrostatic brush in contact with the photoconductive surface of drum 22. The particles are cleaned from the drum 22 by rotation of the brush in contact therewith.

Belt 10 is cleaned in a like manner after transfer of the multicolor image to the copy sheet. Subsequent to cleaning, a discharge lamp (not shown) floods the photoconductive surface of drum 22 to dissipate any residual electrostatic charge remaining thereon prior to the charging thereof for the next successive imaging cycle.

It is believed that the foregoing description is sufficient for the purposes of the present application to illustrate the general operation of a tandem printing machine.

Turning now to FIGS. 1–4 inclusive, there is illustrated the configurations of belt and toner reflectivity for which the methods described herein provide optimum optical contrast. These four figures assume the requirement that registration mark sensing contrast for all colors be in the same direction (so that all zero crossings from positive to negative signals or the opposite are sensed). The methods described herein are applicable to any geometric form of registration mark in a variety of different types of photodetectors. For clarity and convenience, the schemes will be described in terms of chevron marks and bicell detectors such as those described in U.S. application Ser. No. 07/899,187.

In each case discussed below the desired geometric shape is imaged onto the photoreceptor and transferred to the intermediate belt 10. The bicell detectors 100 are of the type which are divided into subsections comprising known photoemitter/photosensor pairs. Preferably, the emitter/sensor pair is in close proximity because the reflected light pattern is more precisely detected by such a device. The output of the emitter/sensor pair corresponds to the degree of reflectivity of the mark being sensed and can also determine the degree of reflectivity of the background material (i.e. the intermediate belt 10).

To determine which of the schemes below should be utilized a test patch of each color toner should be sensed for its reflectivity as well as the image receiving medium (intermediate belt). The shape of the pattern imaged is controlled by controller 90. The output signal of the detectors 100 is then received by the controller 90 and the degree of reflectivity of each toner and the belt 10 is determined. The reflectivity determination should be performed at the time a machine is built and can be repeated whenever a toner supply or belt is changed to assure that the optimum optical contrast is being maintained. The discussion has been primarily directed to a dry toner process, however, is equally adaptable to a process using a liquid toner or even a thermal ink jet process in which accurate registration parameters must be maintained.

Figure 1:
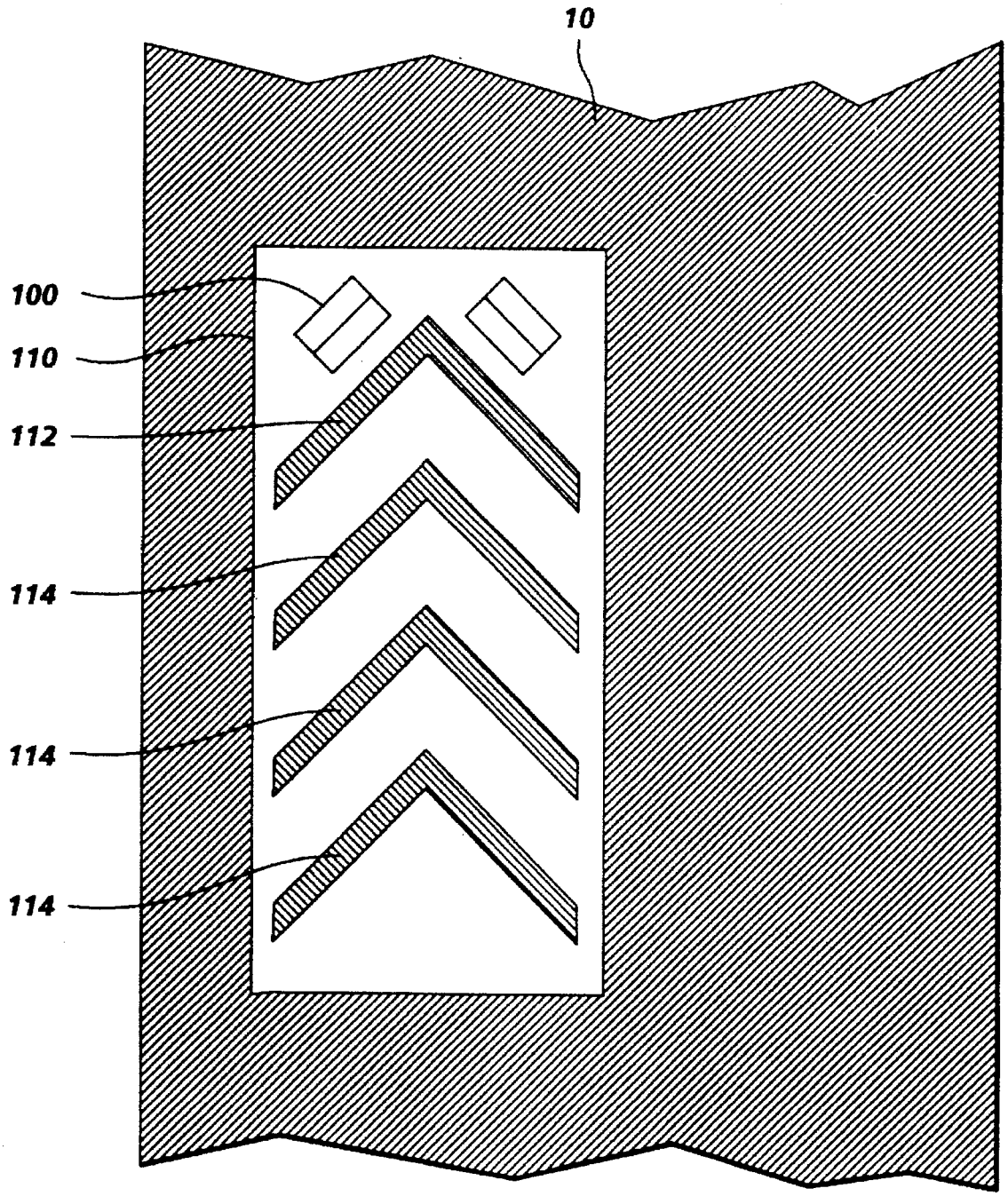
FIG. 1 shows a pattern arrangement for using the present invention for contrasting the belt and the multicolor toners under a first set of conditions.

Turning first to FIG. 1, we will consider the condition that will occur when a non-reflective or transparent intermediate belt 10 is employed, infrared illumination is present in the mark detector, all of the colorants except black have high diffuse reflectivity, and the black toner has a low diffuse reflectivity. In referring to the infrared (IR) illumination, it should be noted that substantial IR radiation accompanies visible radiation from most light sources The term as used in these examples is intended to describe situations in which the illumination is only at IR or near IR wavelengths, or, that the unfiltered near IR content of the light source dominates the total radiation from the source. In an example such as that illustrated in FIG. 1, the bicell detectors 100 are shown in the sensing position. For one of the colored toners having high diffuse reflectivity, the mark is formed by placing a swath 110 of the color toner on the intermediate belt 10 and leaving a void 112 in the swath in the shape of the mark to be detected. To detect the black toner, a chevron mark 114 or other geometric shape is laid down on top of the swath 110 of the bright color toner.

Figure 2:
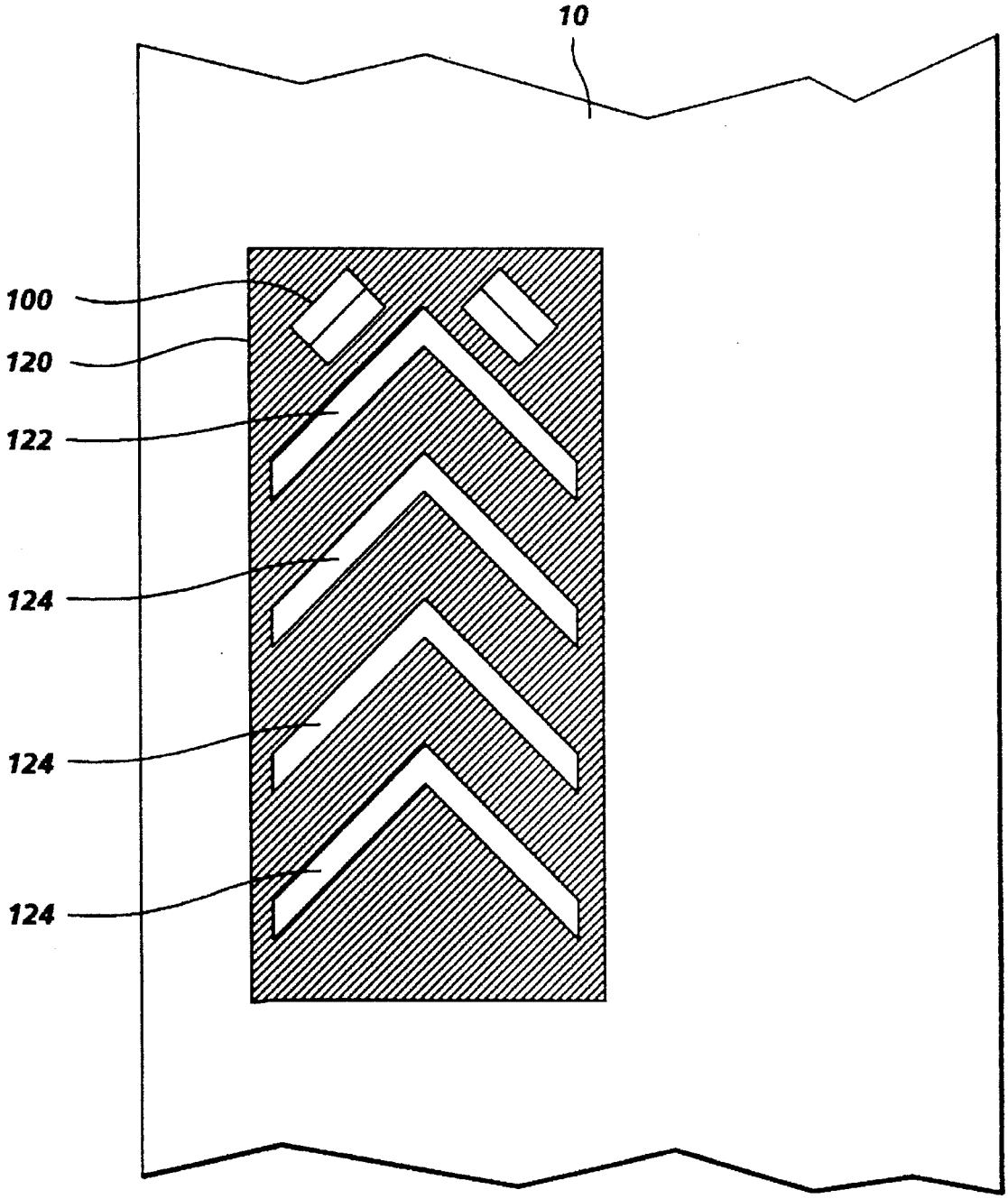
FIG. 2 shows a pattern arrangement for using the present invention for contrasting the belt and the multicolor toners under a second set of conditions.

In FIG. 2, the conditions are such that a highly reflective intermediate belt 10 is employed, infrared illumination is present in the mark detector 100, all colorants except black have a high diffuse reflectivity, and the black toner has low diffuse reflectivity. In the case illustrated in FIG. 2, to create the proper optical contrast, a swath 120 of black toner is laid down on the belt. The color toners 124 are then laid down on top of the black toner in the geometric shape of the mark to be sensed. To create the black registration mark, a void 122 in the swath 120 of black laid down on the belt 10 in the proper geometric shape is created. Thus, the sensors 100 are able to distinguish between the low reflectivity of the black and the high diffuse reflectivity of the other color toners, and the low reflectivity of the black and the high diffuse reflectivity of the intermediate belt to determine the position of the black registration image.

Figure 3:
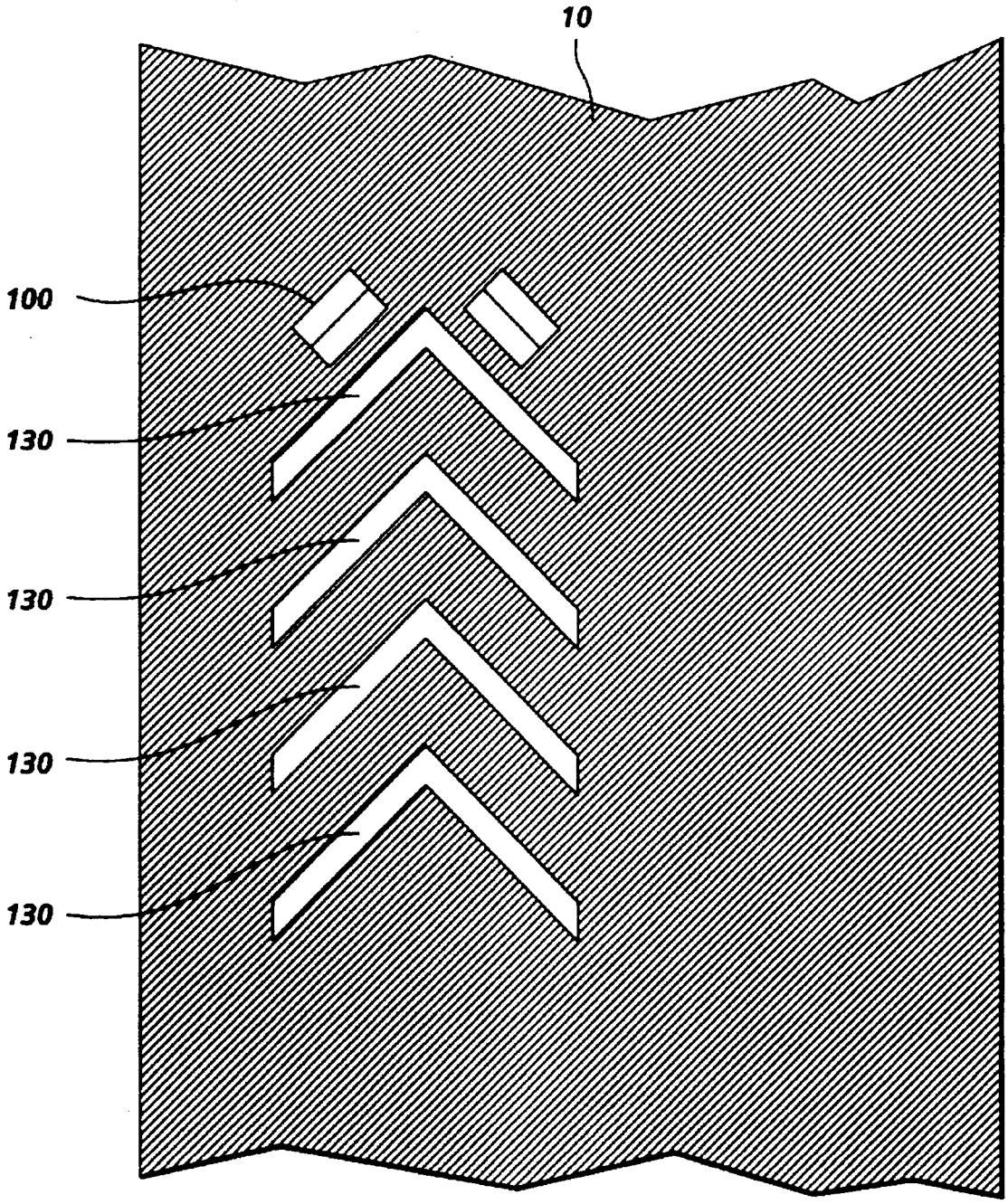
FIG. 3 shows a pattern arrangement for using the present invention for contrasting the belt and the multicolor toners under a third set of conditions.

FIG. 3 illustrates the conditions when a non-reflective or transparent intermediate belt 10 is employed, infrared illumination is present in the mark detector, and all colorants including black have high diffuse reflectivity. In a case such as that illustrated in FIG. 3, all of the colors and black are written directly to the belt in the geometric pattern 130 that will be sensed by the bicell detectors 100. Since each of the colors and black have a high diffuse reflectivity relative to the intermediate belt or transparent photoreceptor belt, there is no need for a background pattern and the individual geometric patterns have the proper contrast and are sensed directly. Since all of the colors and black have high reflectivity relative to the intermediate belt, the detectors sense the marks as light on dark.

Figure 4:
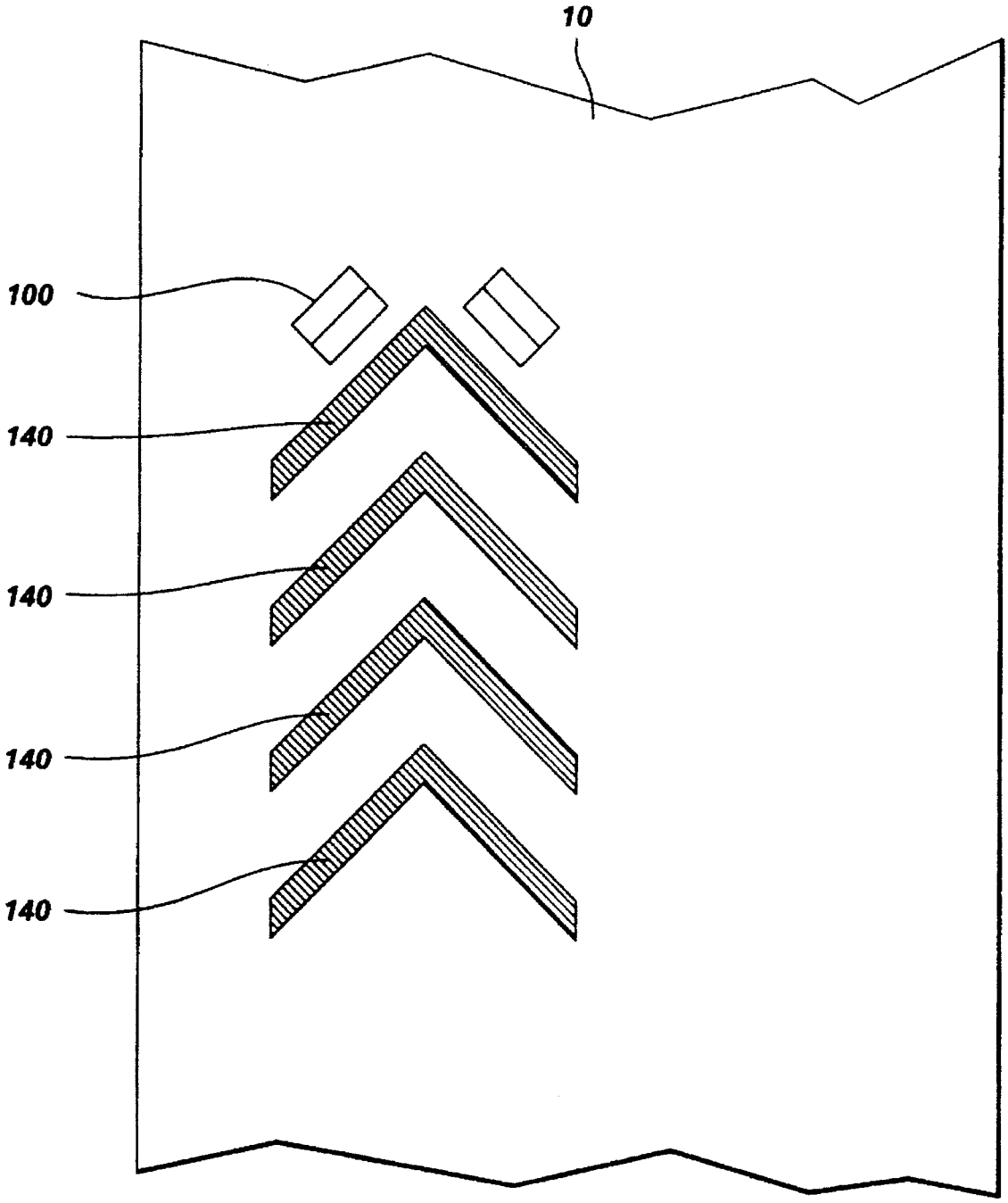
FIG. 4 shows a pattern arrangement for using the present invention for contrasting the belt and the multicolor toners under a fourth set of conditions.

Lastly, turning to FIG. 4, the conditions illustrated therein are that in which a highly reflective intermediate belt 10 is employed, visible illumination is used, a color filter in the system causes all colorants to have low reflectivity when compared with the high reflectivity of the intermediate belt. In this instance, once again each of the registration marks 140 are printed directly to the intermediate belt in the geometric pattern which is to be sensed by the detectors 100. Since all of the colors and black have low reflectivity relative to the intermediate belt, the detectors sense the marks as dark on light. As in the case above with FIG. 3, in FIG. 4 the marks are then directly sensed due to the contrast in reflectivity between each color of the mark and the belt.

In summary, there are essentially two schemes which can be utilized with intermediate layer toner fields to enable reliable registration marks to be created on a belt. In the first case, when some toners have poor contrast with respect to the belt but at least one toner has good contrast with respect to the belt, then the toner with good contrast is deposited first providing a uniform background field and then the poor contrast toner registration marks are deposited on top of a locally uniform region of the good contrast toner. In the second case, in order to make the contrast sensing of the registration marks uniform among the toners, the registration pattern of a toner having good contrast with respect to the belt can be formed as a field with omitted toner in the desired mark shape.

In the cases where all of the toners have good optical contrast with respect to the belt such as that illustrated in FIGS. 3 and 4 above, then each of the registration marks can be written directly in the geometric pattern to be sensed and as a result of the contrasts between the toners and the belt the marks can be directly sensed.

In recapitulation, there is provided a method of achieving optimum optical contrast for detecting registration marks in a multicolor electrophotographic printing machine. The reflectivity of the image carrying member which is usually an intermediate transfer belt is determined. The reflectivity of the toners are then determined. If one of the toners has a contrasting reflectivity, while the remaining toners do not contrast then a uniform field of the contrasting toner is imaged and developed and the registration marks for the other toner colors are then developed on top of the uniform field. A void in the field in the shape of the other toner marks is used as the registration mark for the contrasting toner. If all of the toners have a contrasting reflectivity with the belt, the registration marks are imaged and developed directly on the belt.

It is, therefore, apparent that there has been provided in accordance with the present invention, a method of achieving toner and belt contrast for registration detectors that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method of achieving optical contrast between an image carrying media having a certain reflectivity value and a plurality of marking materials having a reflectivity value, comprising the steps of:

determining the reflectivity value of the image carrying media;

determining the reflectivity value for each of the plurality of marking materials;

depositing a uniform pattern, based on the determined reflectivity values of the image carrying media and the plurality of marking materials, of at least one of the marking materials having a reflectivity value contrasting from the determined reflectivity values of the image carrying media when not all of the marking materials have a determined reflectivity value different from the image carrying media reflectivity value;

depositing a geometric pattern, based on the determined reflectivity values of the image carrying media and a remaining plurality of marking materials, with the remaining plurality of marking materials having a reflectivity value that does not contrast with the image carrying media reflectivity value, over the uniform pattern of the one contrasting marking material so as to obtain maximum optical contrast;

creating a void, comprising an absence of marking material, in the uniform pattern of the contrasting marking material in a geometric pattern substantially equivalent to the geometric pattern of the plurality of non-contrasting marking materials so that a contrasting mark of high contrast toner and the image carrying media is created.

2. The method according to claim 1, further comprising:

sensing positions of the plurality of geometric patterns of the marking materials and the geometric void pattern in the uniform pattern; and adjusting a position of a writing source accordingly so as to register the plurality of marking materials to create multi-color images.

3. The method according to claim 1, further comprising the step of depositing a plurality of powder marking particles on the image carrying media.

4. The method according to claim 1, further comprising the step of depositing a plurality of liquid marking particles on the image carrying media.

* * * * *